US009388671B2

(12) United States Patent
Holderman

(10) Patent No.: US 9,388,671 B2
(45) Date of Patent: Jul. 12, 2016

(54) SWELLABLE SCREEN ASSEMBLY WITH INFLOW CONTROL

(75) Inventor: Luke Holderman, Plano, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 467 days.

(21) Appl. No.: 13/880,799

(22) PCT Filed: Jun. 28, 2012

(86) PCT No.: PCT/US2012/044578
§ 371 (c)(1),
(2), (4) Date: Nov. 7, 2013

(87) PCT Pub. No.: WO2014/003756
PCT Pub. Date: Jan. 3, 2014

(65) Prior Publication Data

US 2014/0048279 A1 Feb. 20, 2014

(51) Int. Cl.
*E21B 43/08* (2006.01)
*E21B 43/12* (2006.01)
*E21B 43/10* (2006.01)

(52) U.S. Cl.
CPC ..... *E21B 43/08* (2013.01); *E21B 43/108* (2013.01); *E21B 43/12* (2013.01)

(58) Field of Classification Search
CPC ..... E21B 43/082; E21B 43/08; E21B 43/12; E21B 34/08; E21B 43/14; Y10T 137/2093; Y10T 137/2098; F15D 1/0015
See application file for complete search history.

(56) References Cited

U.S. PATENT DOCUMENTS 3,441,084 A * 4/1969 Fredd ..... E21B 23/04 166/189
3,586,104 A * 6/1971 Hyde ..... E21B 49/08 138/42
6,476,169 B1 11/2002 Eoff et al.
2009/0008088 A1* 1/2009 Schultz ..... E21B 36/02 166/249
2009/0173490 A1 7/2009 Dusterhoft et al.
2010/0051270 A1 3/2010 Dusterhoft et al.

(Continued)

OTHER PUBLICATIONS

International Search Report and Written Opinion for PCT/US2012/044578 dated Feb. 7, 2013.

*Primary Examiner* — Blake Michener
*Assistant Examiner* — Kipp Wallace
(74) *Attorney, Agent, or Firm* — McDermott Will & Emery LLP; Scott Richardson

(57) ABSTRACT

Disclosed is a swellable screen assembly having inflow control capabilities. One swellable screen assembly includes a base pipe comprising a sidewall portion defining at least one opening therein, a rigid member disposed about a first portion of the base pipe and having a piston arranged therein. The piston has a telescoping portion movably arranged within a non-telescoping portion. An autonomous valve is arranged within the piston and provides fluid communication between a filter medium disposed about the base pipe and the opening in the base pipe, the filter medium being coupled to the telescoping portion of the piston. A swellable material is disposed about a second portion of the base pipe and the filter medium is disposed about the swellable material, wherein, as the swellable material expands, the filter medium is displaced toward an inner surface of the wellbore, thereby extending the telescoping portion.

29 Claims, 12 Drawing Sheets

(56) References Cited

U.S. PATENT DOCUMENTS

| | | | |
|---|---|---|---|
| 2011/0036565 | A1 | 2/2011 | Holderman et al. |
| 2011/0042091 | A1 | 2/2011 | Dykstra et al. |
| 2011/0186300 | A1 | 8/2011 | Dykstra et al. |
| 2011/0214876 | A1 | 9/2011 | Dykstra et al. |
| 2011/0266001 | A1 | 11/2011 | Dykstra et al. |
| 2011/0297384 | A1 | 12/2011 | Fripp et al. |
| 2011/0297385 | A1 | 12/2011 | Dykstra et al. |
| 2011/0308806 | A9 | 12/2011 | Dykstra et al. |
| 2012/0060624 | A1 | 3/2012 | Dykstra |
| 2012/0061088 | A1 | 3/2012 | Dykstra et al. |
| 2012/0111577 | A1 | 5/2012 | Dykstra et al. |

* cited by examiner

SWELLABLE SCREEN ASSEMBLY WITH INFLOW CONTROL

CROSS-REFERENCE TO RELATED APPLICATIONS

The present application claims priority to and is a National Stage entry of International Application No. PCT/US2012/044578 filed on Jun. 28, 2012.

BACKGROUND

The present disclosure relates to downhole tools and, in particular, a swellable screen assembly having inflow control capabilities.

Hydrocarbons can be produced through a wellbore traversing a subterranean formation. In some cases, the formation may be unconsolidated or loosely consolidated. Particulate materials, such as sand, from these types of formations may be produced together with the hydrocarbons. Production of particulate materials presents numerous problems, e.g., particulate materials being produced at the surface, causing abrasive wear to components within a production assembly, partially or fully clogging a production interval, and/or causing damage to production assemblies by collapsing onto part or all of the production assemblies.

Expandable sand control screens can be used to provide stability to a formation to prevent or reduce formation and borehole collapses and also filter particulate materials from hydrocarbon fluids. Expandable sand control screens can include a swellable material, such as a high-swelling rubber, and a filter device on the exterior of the swellable material. The swellable material can be located proximate the production interval and, when activated by a fluid, expand to displace the filter device to the wellbore. The filter device can include perforations through which hydrocarbon fluids from the formation can be received and directed into a production pipe. This type of expandable sand control screen can be effective in filtering and providing formation stability.

In some applications, however, the swellable material may expand into the perforations after contacting the activating fluid. Expanding into the perforations may result in the swellable material partially or completely plugging the perforations of the filter device. Plugged perforations can reduce or prevent hydrocarbon fluids from flowing to an internal flow path of the production pipe, which is generally undesirable. In some cases, a rework of the control screen assembly may be required to alleviate the plugging. Reworks cost substantial time and money because they require suspension of hydrocarbon production for a considerable amount of time and require duplication of work in locating the control screen assembly in the wellbore.

Additionally, in some applications, it is often beneficial to be able to regulate flow of fluids from the subterranean formation into the wellbore while controlling the migration of particulates into the wellbore. Regulating fluids may balance production among zones along the wellbore and mitigate and/or prevent water or gas coning. Further, some fluid flow regulating devices may be designed to maximize oil production and minimize water and/or gas production.

Generally, fluid flow regulation is achieved by directing fluid flow through a nozzle or Venturi device. However, when used in conjunction with applications having low flow rates, as seen with sand screens having pistons, the size of nozzles and Venturi devices need to be small to achieve the desired fluid flow regulation. Because of their size, the nozzles and Venturi devices can be clogged easily, for example, with only a few particulates. Consequently, screen assemblies that can provide radial support to formations, reduce or eliminate plugging, and incorporate fluid flow regulation are desirable.

SUMMARY OF THE DISCLOSURE

The present disclosure relates to downhole tools and, in particular, a swellable screen assembly having inflow control capabilities.

In some embodiments, a screen assembly capable of being disposed in a bore is disclosed. The screen assembly may include a base pipe comprising a sidewall portion defining at least one opening therein; a rigid member disposed about a first portion of the base pipe and having a piston arranged therein, the piston having a telescoping portion movably arranged within a non-telescoping portion; an autonomous valve arranged within the piston and providing fluid communication between a filter medium and the at least one opening in the base pipe, the filter medium being disposed at least partially about the base pipe and coupled to the telescoping portion of the piston; and a swellable material disposed about a second portion of the base pipe, the filter medium being at least partially disposed about the swellable material and being capable of filtering fluids and directing the fluids to the piston, wherein, as the swellable material expands, at least part of the filter medium is displaced toward an inner surface of the bore, thereby extending the telescoping portion.

In other embodiments, a method of producing a fluid composition from a subterranean formation is disclosed. The method may include introducing a screen assembly into the subterranean formation, the screen assembly comprising a base pipe defining at least one opening therein, a rigid member disposed about a first portion of the base pipe, a swellable material disposed about a second portion of the base pipe, and a filter medium at least partially disposed about the swellable material and coupled thereto; expanding the swellable material toward an inner surface of a wellbore and thereby actuating a piston arranged within the rigid member, the piston having a telescoping portion coupled to the filter material and movably arranged within a non-telescoping portion of the piston; filtering the fluid composition through the filter material and directing a filtered fluid to the piston; and regulating a flow of the filtered fluid composition through the piston with an autonomous valve arranged within the piston, the autonomous valve providing fluid communication between the filter medium and the at least one opening in the base pipe.

In yet other embodiments, another screen assembly capable of being disposed in a wellbore is disclosed. The screen assembly may include a base pipe comprising a sidewall portion having a first portion that defines a first opening and a second portion that defines a second opening; a first rigid member disposed about the first portion of the base pipe and having a first piston arranged therein, the first piston having a first telescoping portion movably arranged within a first non-telescoping portion; a second rigid member disposed about the second portion of the base pipe and having a second piston arranged therein, the second piston having a second telescoping portion arranged within a second non-telescoping portion; a first autonomous valve arranged within the first piston and providing fluid communication between a filter medium and the first opening in the first base pipe, the filter medium being disposed at least partially about the base pipe and coupled to the first telescoping portion of the first piston near a first end of the filter medium; a second autonomous valve arranged within the second piston and providing fluid communication between the filter medium and the second opening in the second base pipe, the filter medium also being coupled to the second telescoping portion of the second piston near a second end of the filter medium; and a swellable material disposed about a third portion of the base pipe located between the first portion and the second portion, the filter medium being at least partially disposed about the swellable material and capable of filtering fluids and directing the fluids to the first piston and the second piston, wherein, as the swellable material expands, at least a portion of the filter medium is displaced toward a surface of the wellbore, thereby extending the first and second telescoping portions.

The features and advantages of the present disclosure will be readily apparent to those skilled in the art upon a reading of the description of the preferred embodiments that follows.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

Figure 1A:
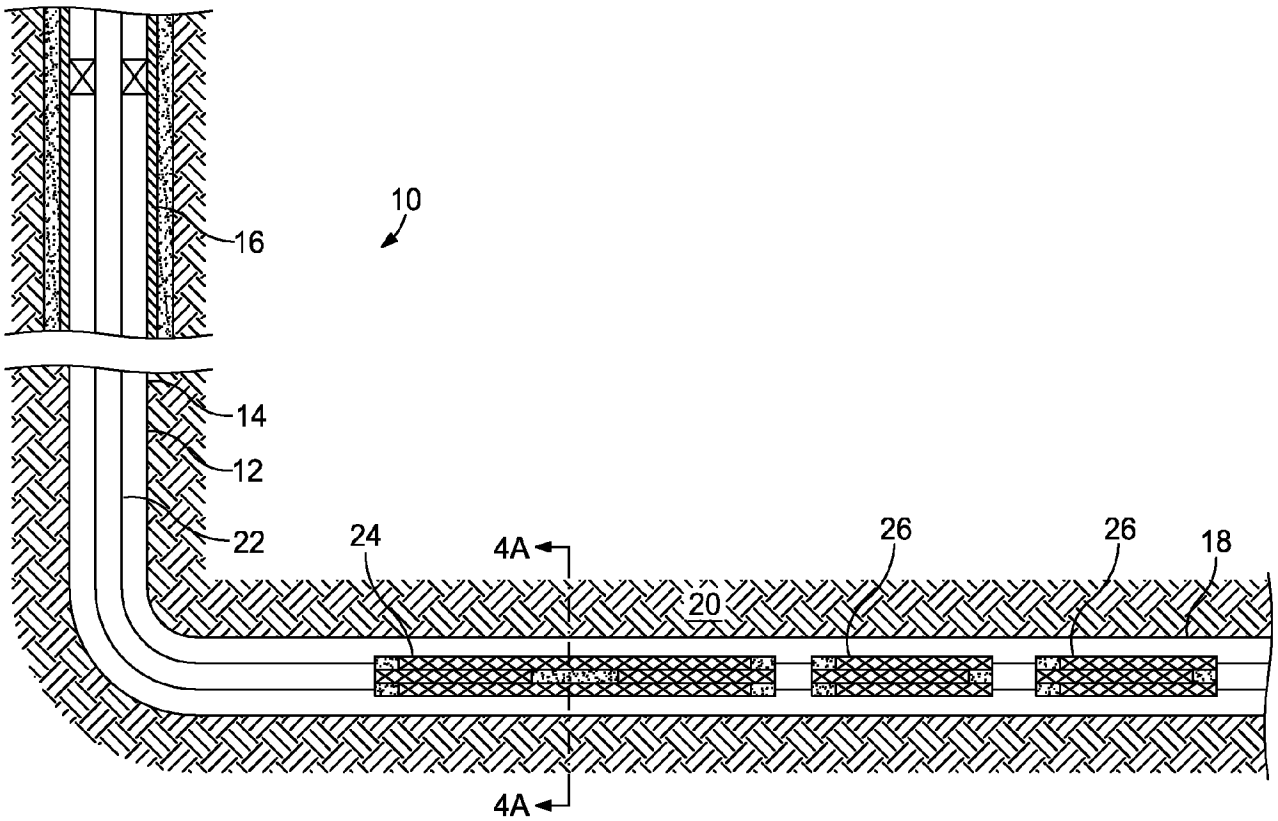
FIG. 1A-B shows a well system with screen assemblies according to certain embodiments of the present disclosure disposed in a wellbore in a running configuration and operating configuration, respectively.

The present disclosure relates to downhole tools and, in particular, a swellable screen assembly having inflow control capabilities.

Certain aspects and embodiments of the present disclosure relate to screen assemblies capable of being disposed in a borehole, such as a wellbore, of a subterranean formation for use in producing hydrocarbon fluids from the formation. The screen assemblies of the present disclosure may, in some embodiments, be configured to provide radial support to a wellbore, support filter mediums that reduce or eliminate plugging of a wellbore by swellable material while providing sand control, and/or integrate fluid flow control with an autonomous valve having an inlet and outlet sized to mitigate clogging from particulates that traverse the filter medium.

A screen assembly according to some embodiments may include a base pipe, a rigid member, a filter medium, a swellable material, and a piston having an autonomous valve. The base pipe can have a sidewall portion that defines an opening therein. The rigid member can be disposed exterior to a first portion of the base pipe and include a piston in fluid communication with the opening of the base pipe. The piston can include a telescoping portion and an autonomous valve. In one embodiment, the swellable material may be disposed exterior to a second portion of the base pipe. The filter medium can be at least partially disposed exterior to the swellable material, where the filter medium is coupled to the telescoping portion of the piston and is in fluid communication with the opening of the base pipe through at least the piston and autonomous valve. The filter medium can further be capable of filtering fluids and directing the fluids to the piston. Generally, in response to contact with an activating fluid, the swellable material is capable of expanding, displacing at least part of the filter medium toward a surface of the bore, and extending the telescoping portion from the piston.

A screen assembly according to some embodiments includes one or more filter mediums supported by a rigid member located exterior to a part of a base pipe. The filter mediums may be in fluid communication with an inner diameter of the base pipe through openings in the base pipe in fluid communication with openings in the filter member through an autonomous valve in a piston. Swellable material can be disposed exterior to a second part of the base pipe and adjacent to the rigid member. The filter medium(s) can be displaced by the swellable material to contact a wall of the bore, and the rigid members can help reduce or prevent plugging of screen assembly openings. An autonomous valve in the piston can provide fluid flow control through the piston, i.e., between the inner diameter of the base pipe and the borehole.

In some embodiments, a screen assembly of the present disclosure is a sand control screen assembly configured to reduce or otherwise prevent production of particulate materials from a wellbore that traverses a hydrocarbon-bearing subterranean formation, but is also able to operate as an injection well. In sand control screen assembly embodiments, the screen assembly may advantageously utilize autonomous valves having inlets and outlets sized to mitigate particulate plugging.

FIG. 1A shows a well system 10 with exemplary screen assemblies, according to certain embodiments of the present disclosure. The well system 10 includes a wellbore 12 that extends through various earth strata and includes a substantially vertical section 14 and a substantially horizontal section 18 connected thereto. The substantially vertical section 14 includes a casing string 16 cemented at an upper portion of the substantially vertical section 14. The substantially horizontal section 18 is open hole and extends through a hydrocarbon bearing subterranean formation 20.

A tubing string 22 extends from the surface within the wellbore 12 and provides a conduit for formation fluids to travel from the substantially horizontal section 18 to the surface. In other applications, the tubing string 22 may provide a conduit for the injection of fluids into the subterranean formation 20. One or more screen assemblies 24, 26 may be positioned with or otherwise coupled to the tubing string 22 in the substantially horizontal section 18. The screen assemblies 24, 26 are shown in a running or unextended configuration. In some embodiments, the screen assemblies 24, 26 are sand control screen assemblies that can filter particulate materials from hydrocarbon fluids, direct the hydrocarbon fluids to an inner diameter of the tubing string 22, and simultaneously stabilize the formation 20.

Figure 1B:
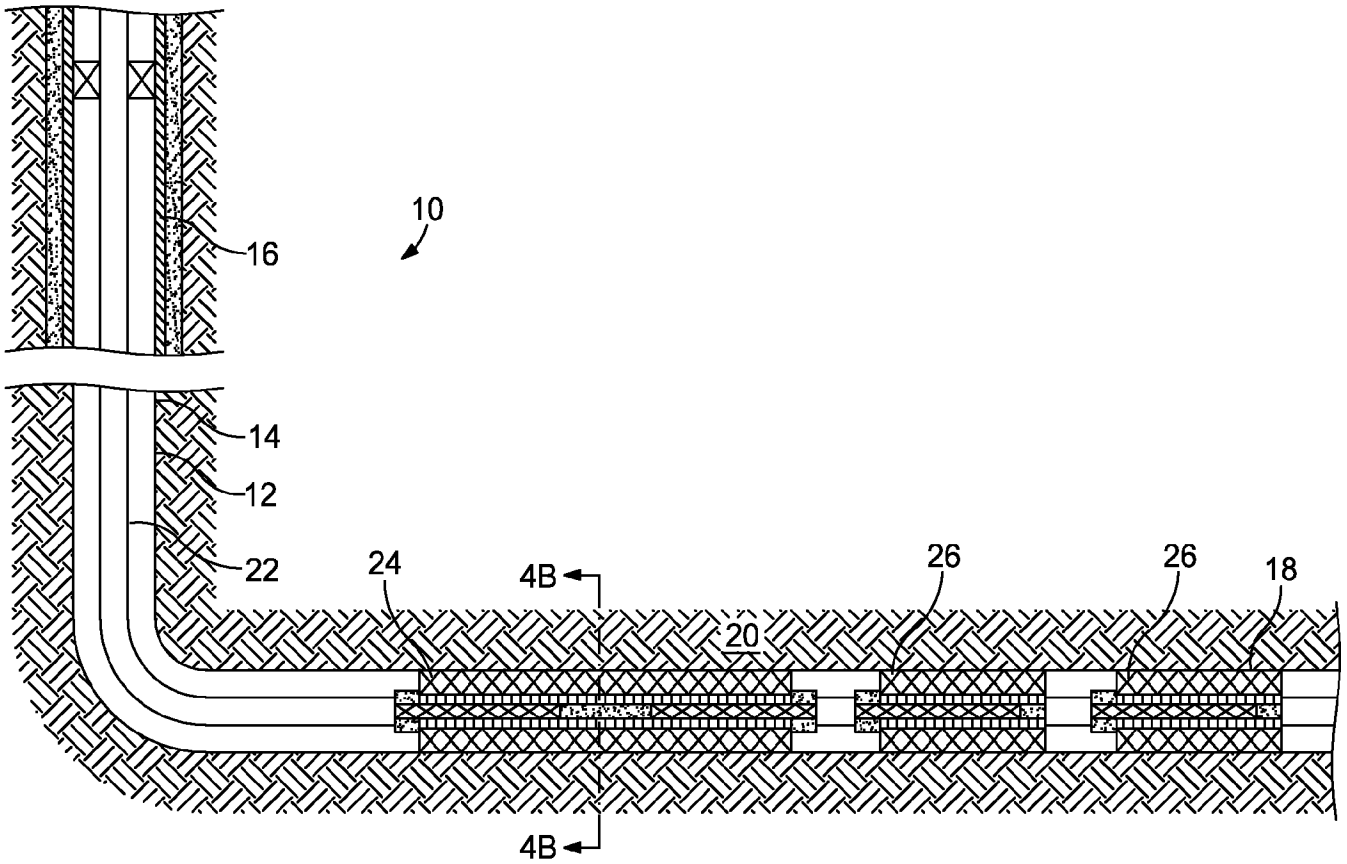

FIG. 1B shows the well system 10 with the screen assemblies 24, 26 in an operating or a radially expanded configuration. Each of the screen assemblies 24, 26 can include a base pipe, a rigid member, swellable material, and filter mediums, as known in the art. Generally, the rigid member includes at least one piston that, at least in part, provides fluid communication between the filter mediums and an opening in the base pipe, which is part of the fluid communication between the subterranean formation and the flow path in the inner diameter of the base pipe. Generally, the piston includes an autonomous valve for regulating fluid flow therethrough. The rigid member, or a component thereof, may be a ring made from a metal, composite polymer, non-swelling rubber compound, or the like, and may be disposed exterior to a portion of the base pipe. Examples of metals from which the rigid member, or component thereof, may be made include steel, iron, brass, copper, bronze, tungsten, titanium, cobalt, nickel, combinations thereof, and the like. The swellable material may be a relatively high swelling rubber or polymer and may be disposed exterior to another part of the base pipe. The filter mediums may be coupled to the exterior of the swellable material and supported by part of the rigid member at least in a running configuration.

When an activating fluid contacts the screen assemblies 24, 26, the swellable material of each of the screen assemblies 24, 26 may be configured to expand. Expansion of the swellable material serves to displace the filter mediums of the screen assemblies 24, 26 to contact an interior surface of the wellbore 12. The activating fluid may be any fluid to which the swellable material responds by expanding. Examples of activating fluid include hydrocarbon fluids, water, brines, a gas, combinations thereof, and the like.

The first screen assembly 24 may be a screen assembly that includes filter mediums that are laterally and longitudinally adjacent to each other. The subsequent screen assemblies 26 may be screen assemblies that include filter mediums that are only laterally adjacent to each other.

Although FIGS. 1A-B show the tubing string 22 with only screen assemblies 24, 26, it will be appreciated that the tubing string 22 may include any number of other tools and systems in addition to the screen assemblies 24, 26. Examples of other tools and systems include fluid flow control devices, communication systems, and safety systems. The tubing string 22 may also be divided into intervals using zonal isolation devices such as packers. Zonal isolation devices may be made from materials that can expand upon contact with a fluid, such as hydrocarbon fluids, water, and gas.

In addition, FIGS. 1A-B show screen assemblies according to certain embodiments of the present disclosure in the substantially horizontal section 18 of the wellbore 12. Various screen assembly embodiments according to the present disclosure, however, can be used in deviated, vertical, or multilateral wellbores. Deviated wellbores may include directions different than, or in addition to, a general horizontal or a general vertical direction. Multilateral wellbores can include a main wellbore and one or more branch wellbores. Directional descriptions are used herein to describe the illustrative embodiments but, like the illustrative embodiments, should not be used to limit the present disclosure.

As stated above, certain embodiments of the present disclosure can be disposed in an injection well. Typically, in an injection well, water or other fluid is injected into the well to increase flow of hydrocarbon fluids to a nearby production well. Screen assemblies according to certain embodiments of the present disclosure can be disposed in the injection well to provide wellbore support during and after the fluid injection process. In some embodiments, injected fluid exits a base pipe through a plurality of apertures defined in the base pipe, passes through the autonomous valve in the piston of a rigid member, and through openings or perforations in a filter medium supported by the rigid member. The filter medium may be a support member that does not include filtration material, but includes structure capable of supporting a formation.

Screen assemblies according to some embodiments of the present disclosure can be disposed in a cased hole completion. In a cased hole completion, a large diameter pipe is positioned between a production string and a formation. The large diameter pipe may be a base pipe with openings in a sidewall portion of the base pipe. A screen assembly can be positioned exterior to the large diameter pipe. The screen assembly can include a rigid member with a piston with an autonomous valve that provides, at least in part, the fluid flow path between the filter medium and the inner diameter of a base pipe. A filter medium can be supported by the rigid member and can provide, at least in part, fluid communication between the formation and the piston.

Figure 2:
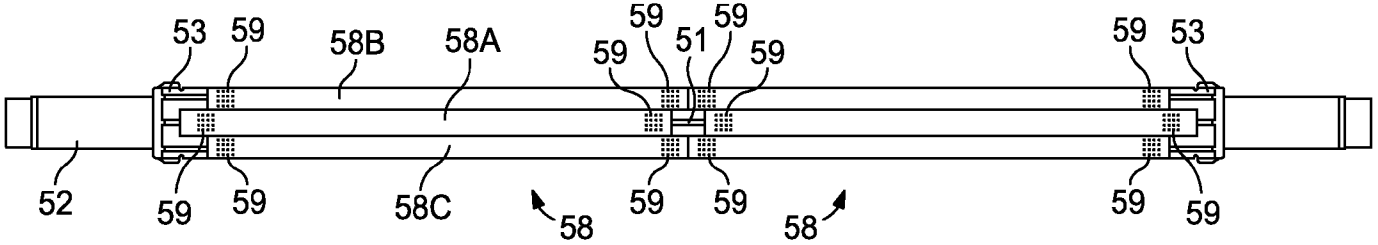
FIG. 2 shows a side view of screen assembly in a running configuration.
Figure 3:
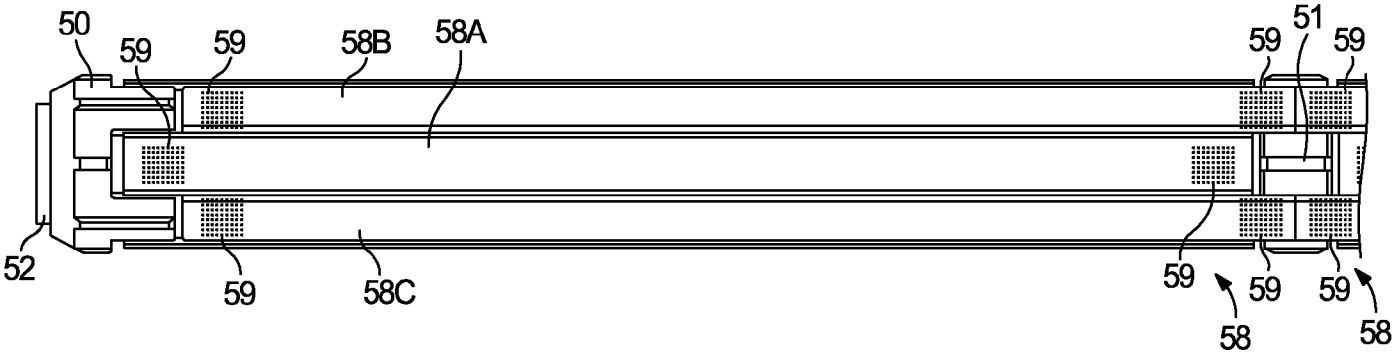
FIG. 3 shows a side view of screen assembly in a running configuration.

FIGS. 2 and 3 show a more detailed view of the first screen assembly 24 in a running configuration. The screen assembly 24 depicted in the figures includes three rigid members 50, 51, 53 located circumferential to a base pipe 52. In at least one embodiment, the rigid members 50, 51, 53 may be coupled to the base pipe 52. Screen assemblies according to various embodiments of the present disclosure can include any number of rigid members. For example, the screen assemblies 26 in FIGS. 1A-B include two rigid members. In other embodiments, the screen assemblies 26 may include one or more than two rigid members. Rigid members 50, 51, 53 may be constructed from any material capable of retaining a general shape upon contact with fluids such as hydrocarbon fluids, gas, and water. Examples of material from which rigid members 50, 51, 53 can be constructed include metal such as steel. In some embodiments, rigid members 50, 51, 53 are rings constructed from steel. The rigid members 50, 51, 53 may include pistons (not shown) that provide, at least in part, fluid communication between filter mediums 58 and the inner diameter of a base pipe 52. In some embodiments, each of the rigid members 50, 51, 53 includes four pistons and each of the four pistons provides, at least in part, fluid communication between filter mediums 58 and the inner diameter of the base pipe 52. In some embodiments, the rigid members 50, 51, 53 may each independently include any number of pistons, e.g., 1 to 5 pistons, or more.

Swellable material (not shown) can be disposed circumferential to a second portion of the base pipe 52 and between the rigid members 50, 51, 53. Filter mediums 58 are positioned on an exterior of the swellable material and can be supported by the rigid members 50, 51, 53 at least in a running configuration. Each of the filter mediums 58 may be supported by one of the rigid members 50, 51, 53. For example, filter medium 58A is supported by a first rigid member 50 and filter mediums 58B, 58C are supported by a second rigid member 51. In some embodiments, each of the filter mediums 58 is supported by being retained, at least temporarily, by one of the rigid members 50, 51, 53. For example, each of the filter mediums 58 can be retained by grooves defined in one or more of the rigid members 50, 51, 53 in a running configuration and can be allowed to detach from the grooves in an operating configuration. In other embodiments, each of the filter mediums 58 is retained by the grooves defined in the one or more rigid members 50, 51, 53 in the operating configuration or otherwise supported by a piston disposed in one of the rigid members 50, 51, 53.

In some embodiments, the filter mediums 58 may be filtration tubes that extend longitudinally from a rigid member and have a substantially rectangular surface shape. In some embodiments, the filter mediums 58 have a surface shape that resembles, for example, a helicopter blade. Each of the filter mediums 58 can include perforations 59 that allow hydrocarbon fluids to enter the filter mediums 58 for filtration and direct the fluids to an inner flow path of the base pipe 52 through pistons in one or more of the rigid members 50, 51, 53. In the running configuration shown in FIGS. 2 and 3, the filter mediums 58 are arranged adjacent to each other. The swellable material can be configured to expand during an operating configuration thereby displacing the filter mediums 58 radially and expanding the telescopic portion of the piston, as will be described in greater detail below. In some embodiments, the filter mediums 58 are separated by swellable material during the operating configuration.

Filter mediums according to some embodiments of the present disclosure may be or include a control line that can be a fiber optic cable in communication with a sensor capable of contacting a formation. The control line can detect conditions associated with the formation and transmit information about the conditions to the surface for analysis. Filter mediums may also include a fiber optic disposed in housings of the filter mediums to provide condition information in a running configuration or otherwise provide information to protect the filter mediums. In some embodiments, however, control of the filter mediums can be in contact with the surface via telemetry, such as acoustic, electromagnetic, or mud pulse telemetry. Moreover, those skilled in the art will readily appreciate that the filter mediums may be controlled or otherwise monitored remotely from the well surface, such as via wireless communication methods.

Figure 4A:
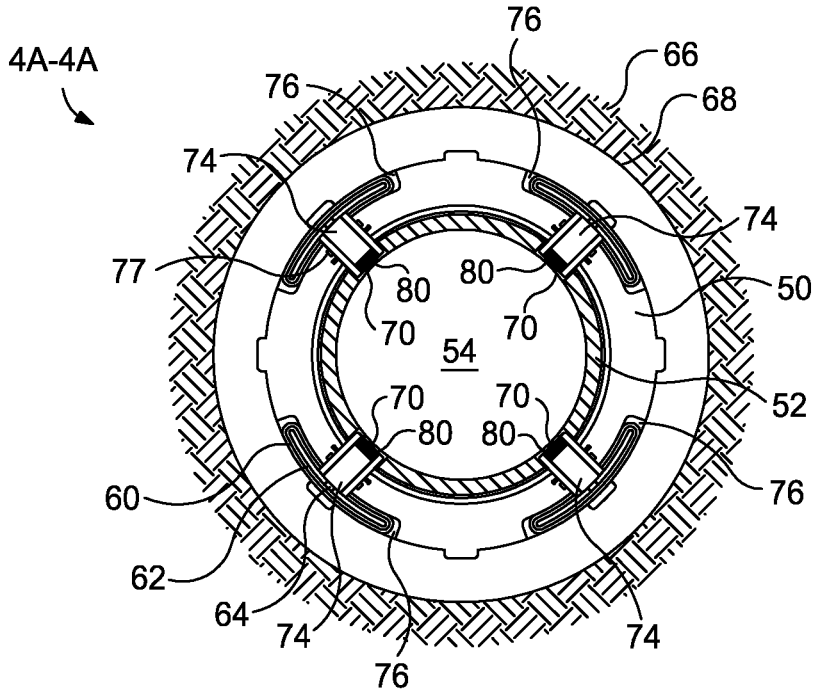
FIGS. 4A-B show a cross-sectional view of one of the rigid members of the screen assembly from FIG. 1A (running configuration) along line 4A-4A and FIG. 1B (operating configuration) along line 4B-4B, respectively
Figure 4B:
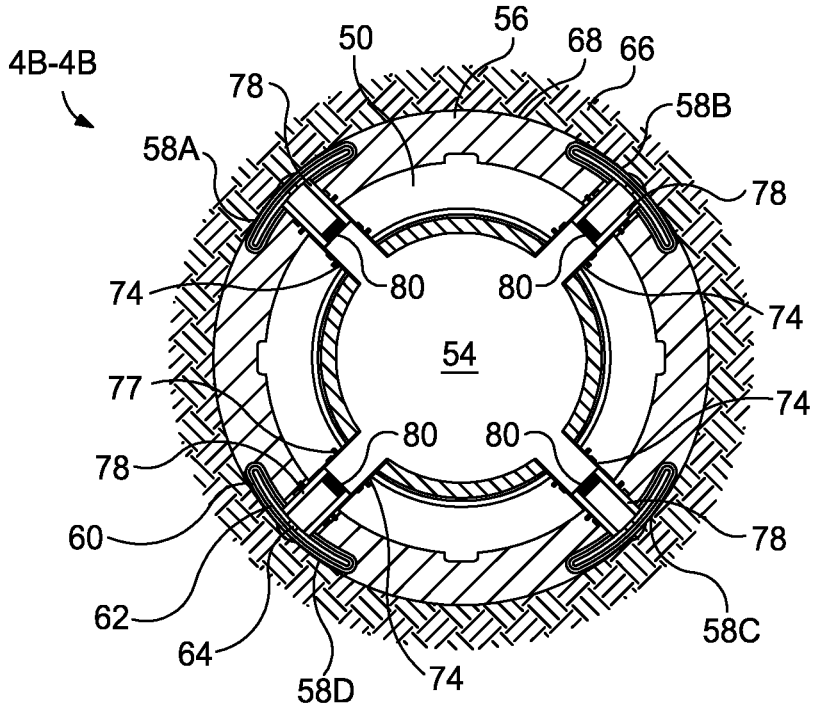

Rigid members that support filter mediums according to certain embodiments of the present disclosure can include one or more pistons that comprise a telescoping portion and an autonomous valve. The pistons may be telescoping pistons that can support the filter mediums in a running configuration and an operating configuration. FIGS. 4A-B show a cross-sectional view of one of the rigid members 50 of the screen assembly 24 from FIG. 1A (running configuration) along line 4A-4A and 1B (operating configuration) along line 4B-4B, respectively. The base pipe 52 may define one or more openings 70 in a sidewall portion thereof. The rigid member 50 may include pistons 74 that are in fluid communication with the openings 70 of the base pipe 52. The pistons 74 can be coupled to the filter mediums 58 (i.e., 58A, 58B, 58C, and 58D, as shown in FIG. 4B). In one or more embodiments, the pistons 74 can include an autonomous valve 80 such that fluid communication between each filter medium 58 and the inner diameter of the base pipe 52, as provided by the pistons 74, passes through each respective autonomous valve 80. In operation, each autonomous valve 80 can provide fluid flow regulation between the filter medium 58 and the interior of base pipe 52. Various configurations of the piston 74 and the autonomous valve 80 are described below.

As illustrated, FIGS. 4A-B illustrate the rigid member 50 as being configured to support four filter mediums that are designated 58A, 58B, 58C, and 58D. It will be appreciated, however, that rigid members according to various embodiments of the present disclosure can support any number of filter mediums.

Each piston 74 of the rigid member 50 may include a telescoping portion 78 that extends radially, as shown in FIG. 4B, when the swellable material 56 expands to displace the filter mediums 58A-D to contact the wellbore 68 at the formation 66. In some embodiments, one or more grooves 77 may be defined in the rigid member 50 circumferential to the pistons 74 and may be configured to receive corresponding O-rings and/or safety catch rings. The O-rings may serve to provide a seal to prevent fluids from traveling between the pistons 74 and the rigid member 50 as the pistons 74 radially translate. The safety catch rings may serve to prevent the pistons 74 from over expanding as the swellable material 56 expands.

The various filter mediums 58A-D may be positioned or otherwise arranged on an exterior of the swellable material 56. In some embodiments, the filter mediums 58A-D are bonded to the exterior of swellable material 56. For example, a relatively low swelling or non-swelling material 76 can be positioned between the exterior of the swellable material 56 and the filter mediums 58A-D. The filter mediums 58A-D can be bonded to the low swelling or non-swelling material 76 and the low swelling or non-swelling material 76 can be bonded to the swellable material 56. The low swelling or non-swelling material 76 may assist in preventing the swellable material 56 from damaging the filter mediums 58A-D upon expansion. Moreover, the low-swelling or non-swelling material 76 may assist the rigid member 50 in supporting the filter mediums 58A-D by providing a temporary seal between the filter mediums 58A-D and the rigid member 50. In some embodiments, the low swelling or non-swelling material 76 is a low swelling or non-swelling rubber.

The swellable material 56 may be configured to expand upon contact with an activating fluid and displace the filter mediums 58A-D to contact a formation 66 at an internal diameter of a wellbore 68. In some embodiments, the filter mediums 58A-D are filtration tubes that can filter particulate materials from hydrocarbon fluids and direct the hydrocarbon fluids to the pistons 74. The filter mediums 58A-D may each include a housing 60 configured to house or otherwise contain filter material 62. The filter material 62 can include a filtration opening 64 through which, in some embodiments, hydrocarbon fluid can be directed to the piston 74. The housing 60 may be made of any suitable material and may be partially perforated to allow hydrocarbon fluids to enter the housing 60 at one or more locations. The filter material 62 may be any suitable material, such as a fine mesh, that can filter particulate materials from hydrocarbon fluid.

As illustrated, the filter mediums 58A-D may have a kidney-shaped cross-sectional design. The kidney-shaped cross-section may assist in attaching the filter mediums 58A-D to the swellable material 56 and may result in more surface area of the filter mediums 58A-D, as compared to filter mediums having a different cross-sectional shape, contacting the wellbore 68 upon expansion of the swellable material 56. Filter mediums according to other embodiments of the present disclosure, however, may have any type of cross-sectional shape. Examples of these types of cross-sectional shapes include an oval, a circle, a rectangle, and any hybrid thereof. The filter mediums 58A-D can have a cross-sectional length that is selected based on the particular requirements of a production interval in which the screen assembly 24 is located.

The swellable material 56 can expand upon contact with an activating fluid. The activating fluid can include hydrocarbon fluid, water, or gas. Various techniques can be used to contact the swellable material 56 with an activating fluid. One technique includes configuring the swellable material 56 to expand upon contact with activating fluids already present within the wellbore when the screen assembly 24 is installed or with activating fluids produced by the formation 66 after installation.

In one or more embodiments, the swellable material 56 may include a mechanism for delaying swell to prevent swelling during installation. Examples of a mechanism for delaying swell include an absorption delaying layer, coating, membrane, composition, combinations thereof, or the like. Another technique includes circulating activating fluid through the well after the screen assembly 24 is installed in the well. In yet other embodiments, the swellable material 56 may be capable of expansion upon its location in an environment having a temperature or a pressure that is above a preselected threshold in addition or alternative to an activating fluid. In some embodiments, sensors may be placed downhole in order to monitor the wellbore conditions and report the same to the surface. Accordingly, operators may be able to determine when the swellable material 56 is about to or when it is expanding.

Expansion of the swellable material 56 can displace the filter mediums 58A-D to contact the formation 66 and thereby extend the corresponding pistons 74. The thickness of the swellable material 56 can be optimized based on the diameter of the screen assembly 24 and the diameter of the wellbore 68 to maximize contact area of the filter mediums 58A-D with the wellbore 68 upon expansion. In some embodiments, part of the swellable material 56 expands between the filter mediums 58A-D and contacts the formation 66 between the filter mediums 58A-D to conform to non-uniform wellbore diameters. In some embodiments, the pre-swelled swellable material 56 may be configured to fill the annulus of the wellbore by about 10%, about 20%, about 50%, about 75% or about 90%. One skilled in the art with the benefit of this disclosure will understand that the number and dimensions of individual filter mediums can be designed to provide for a desired level of contact between the wellbore and the swellable material, which may be minimized to advantageously mitigate formation plugging from the swellable material.

The swelled screen assembly 24 can reduce or eliminate annular flow of hydrocarbon and other fluids, provide multiple flow paths for filtered hydrocarbon fluids, and provide stabilization to the wellbore 68. For example, the swelled screen assembly 24 can provide an amount of radial support to the formation 66 so as to prevent formation collapse. In some embodiments, the swelled screen assembly 24 can provide an amount of collapse support within a range of about 500 psi to about 2000 psi.

Figure 5A:
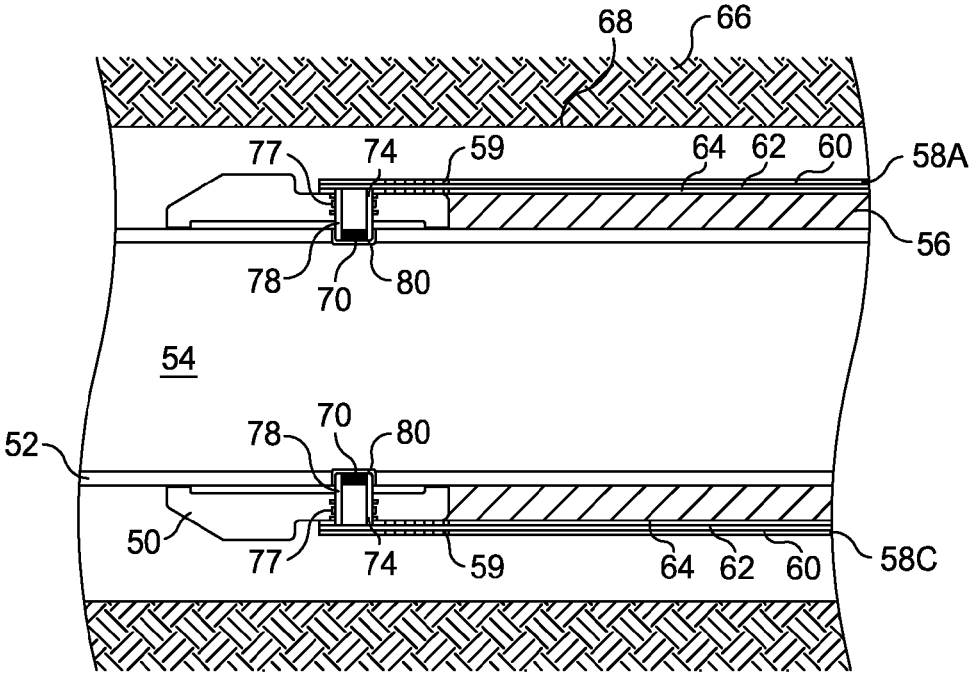
FIGS. 5A-B illustrate cross-sectional side views of one embodiment of the screen assembly disposed in a wellbore in a running configuration and operating configuration, respectively.
Figure 5B:
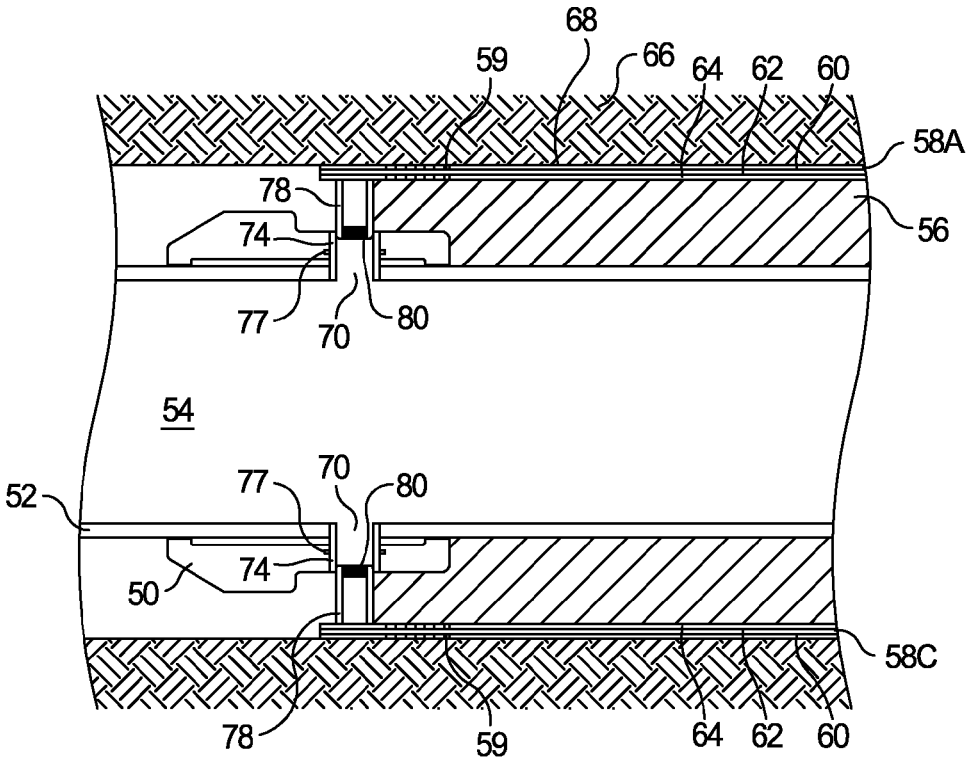

FIGS. 5A-B illustrate cross-sectional side views of one embodiment of the screen assembly 24 disposed in a wellbore 68 in a running configuration and operating configuration, respectively. The screen assembly 24 includes a base pipe 52 that defines an internal flow path 54 through which, in some embodiments, hydrocarbon fluids may travel. As illustrated, the rigid member 50 is disposed exterior to a first portion of the base pipe 52. The rigid member 50 may be a ring made from a metal, composite polymer, non-swelling rubber, or the like. Examples of metals from which the rigid member may be made include steel, iron, brass, copper, bronze, tungsten, titanium, cobalt, nickel, combinations thereof, or the like.

In some embodiments, an interface layer is disposed between the base pipe 52 and at least a portion of the rigid member 50. The interface layer may be configured to bond the rigid member 50 to the base pipe 52. Moreover, the interface layer may also provide a seal between the rigid member 50 and the base pipe 52 to prevent annular flow of fluids from the formation 66.

The base pipe 52 defines the openings 70 in a sidewall portion thereof. The openings 70 fluidly communicate with filter mediums 58A, 58C through the pistons 74 of the rigid member 50. The filter mediums 58A, 58C are supported by the rigid member 50 in the running configuration. The pistons 74 allow for fluid communication between the filter mediums 58A, 58C and the base pipe openings 70, and the autonomous valves 80 arranged within each piston 74 may be configured to regulate fluid flow therethrough.

The swellable material 56 is shown as disposed exterior to a second portion of the base pipe 52 and longitudinally adjacent to the rigid member 50. As depicted, the swellable material 56 is positioned between the base pipe 52 and part of each of the filter mediums 58A, 58C. The swellable material 56 can retain an initial size during run-in into the wellbore 68 and can expand upon contact with an activating fluid in an operating configuration. As briefly described above, the swellable material 56 may be configured to swell and displace the filter mediums 58A, 58C into contact with the wellbore 68 when the swellable material 56 expands in the operating configuration.

Each filter medium 58A, 58C includes a housing 60 for the filter material 62. The housing 60 includes one or more perforations 59 through which hydrocarbon fluids produced by the formation 66 can flow to the filter material 62. In operation, the filter material 62 can filter particulate materials from the hydrocarbon fluids and direct the filtered hydrocarbon fluids through a filtration opening 64 and to the flow path 54 of the base pipe after traversing the piston 74, autonomous valve 80, and base pipe opening(s) 70.

As briefly described above, the pistons 74 can support the filter mediums 58A, 58C in both the running configuration and the operating configuration. For example, the pistons 74 may be coupled to the filter mediums 58A, 58C and include telescoping portions 78 that can extend radially when the swellable material 56 expands and thereby displaces the filter mediums 58A, 58C. The rigid member 50 can isolate openings from the swellable material 56 to reduce or eliminate plugging and/or can allow the screen assembly to be constructed without requiring openings to be included in the swellable material 56.

Figure 6A:
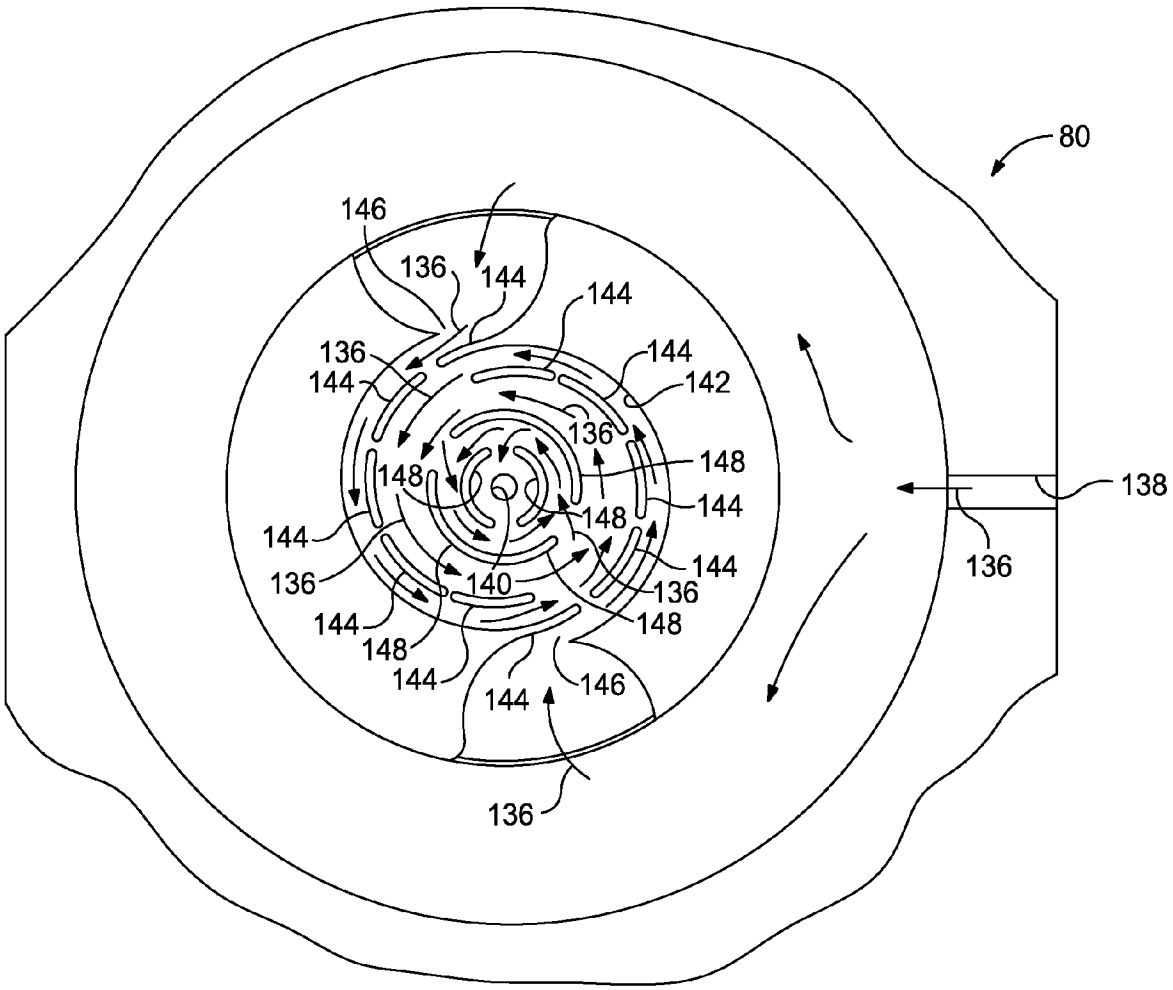
FIGS. 6A-B illustrate the flow path and design of a nonlimiting example of autonomous valves suitable for use in conjunction with the present disclosure.
Figure 6B:
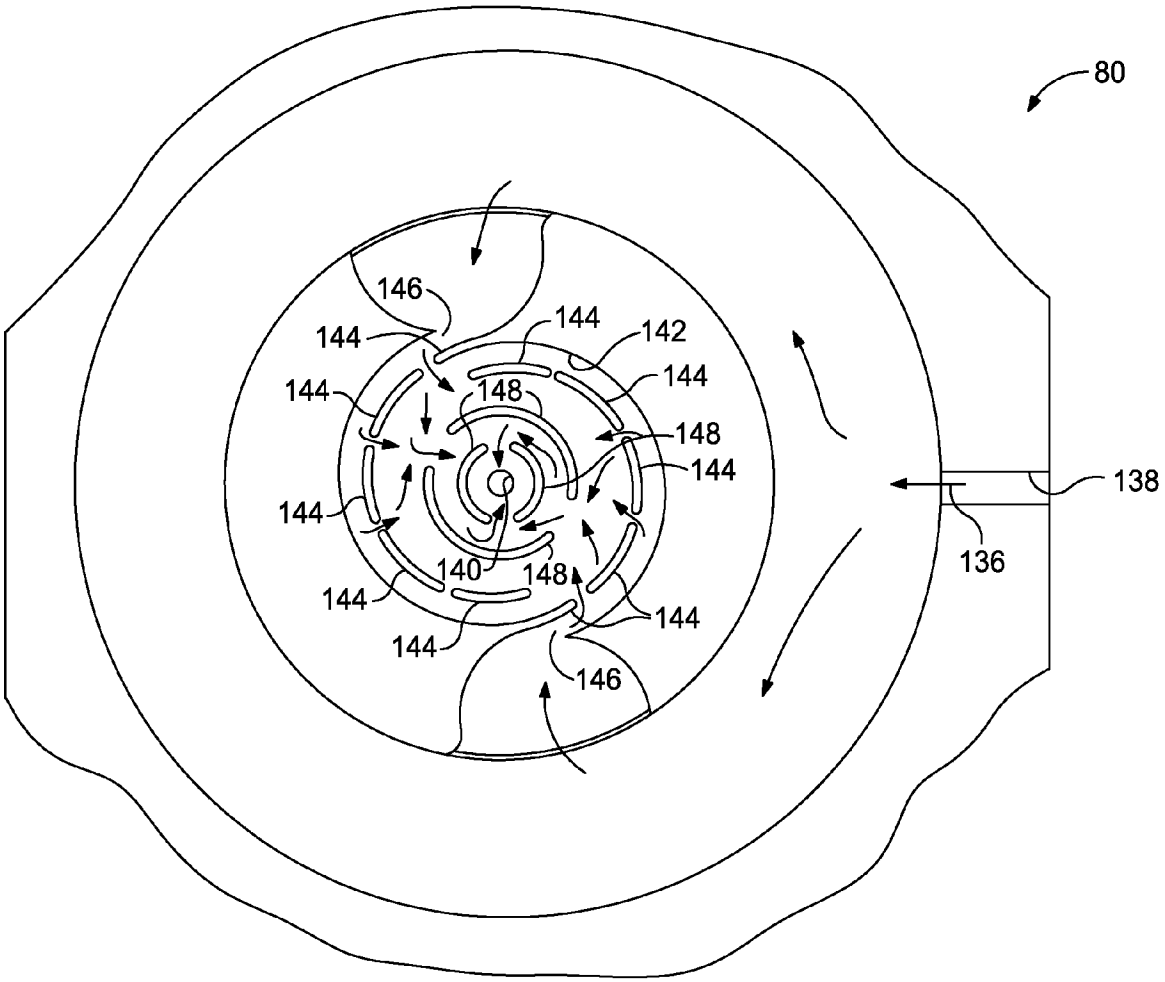
Figure 7:
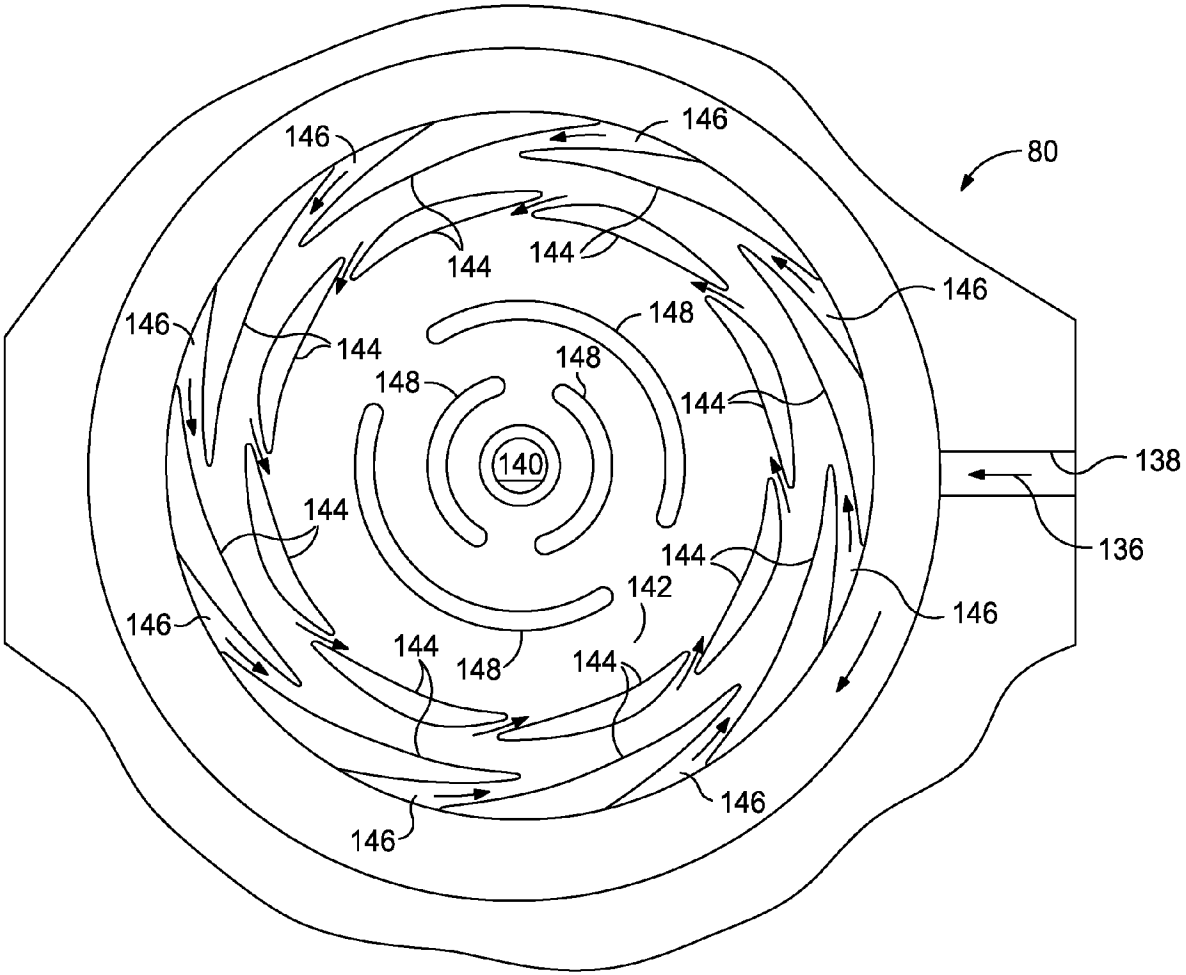
FIG. 7 illustrates the flow path and design of a nonlimiting example of an autonomous valve suitable for use in conjunction with the present disclosure.

FIGS. 6A-B and 7 provide nonlimiting examples of the autonomous valve 80 that may be suitable for use in conjunction with the present disclosure. It should be noted that FIGS. 6A-B and 7 depict a flow path diagrams of the autonomous valve(s) 80, and that for proper function the particular autonomous valve 80 would include a lid or a top in intimate contact with the various structures and components described below so as to properly form the flow paths.

A first configuration of the autonomous valve 80, as representatively illustrated in a planar configuration in FIGS. 6A-B, can include a flow chamber 142 defined between an inlet 138 and an outlet 140, where the flow chamber 142 includes one or more entrances 146 (two shown) and one or more structures 144, 148. FIGS. 6A-B illustrate the fluid flow of fluid compositions 136 which has a relatively low viscosity and/or a relatively high velocity (e.g., gas or water) or a higher viscosity and/or lower velocity (e.g., hydrocarbons).

The structures 144 arranged within flow chamber 142 may be configured to induce a spiraling flow of the fluid composition 136 about the outlet 140. That is, the fluid composition 136 is made to flow somewhat circularly about, and somewhat radially toward, the outlet 140. In some embodiments, the structures 144 may also be configured to impede a change in direction of the fluid composition 136 radially toward the outlet 140. Accordingly, although the spiral flow of the fluid composition 136 as induced by the structures 144 may have both a circular and a radial component, the structures 144 may be configured to impede an increase in the radial component.

As illustrated in FIG. 6A, the structures 144 may be spaced apart from each other in the direction of flow of the fluid composition 136. In some embodiments, the spacing between the structures 144 may decrease incrementally in the direction of the flow of the fluid composition 136. Each of the entrances 146 to the chamber 142, as depicted in FIG. 6A, may include a series of the spaced apart structures 144 associated therewith. However, it will be appreciated that any number of entrances 146 and structures 144 may be provided in keeping with the principles of this disclosure. Moreover, additional structures 148 may be provided in the chamber 142 for impeding a change toward radial flow of the fluid composition 136.

As depicted in FIG. 6A, the additional structures 148 may be both circumferentially and radially spaced apart from each other. The radial spacing between the adjacent structures 144, 148 may be configured to eventually allow the fluid composition 136 to flow to the outlet 140. But, flow energy may be dissipated due to the spiraling and/or circular flow of the fluid composition 136 about the outlet 140, and so a relatively large resistance to flow may be experienced by the fluid composition 136. Furthermore, as the viscosity of the fluid composition 136 decreases and/or as its velocity increases (e.g., due to a decreased ratio of desired to undesired fluids in the fluid composition 136), this resistance to flow will simultaneously increase. Conversely, as the viscosity of the fluid composition 136 increases and/or as its velocity decreases (e.g., due to an increased ratio of desired to undesired fluids in the fluid composition 136), this resistance to flow will simultaneously decrease, as graphically depicted in the illustrative example of FIG. 6B.

In FIG. 6B, for example, the autonomous valve 80 is depicted with such an increased ratio of desired to undesired fluids in the fluid composition 136. Having a higher viscosity and/or lower velocity, the fluid composition 136 is able to more readily flow through the spacing defined between the structures 144, 148. In this manner, the fluid composition 136 flows much more directly to the outlet 140 in the FIG. 6B example, as compared to the FIG. 6A example. This is the direct result of a portion of spiral fluid flow of the fluid composition 136 in the FIG. 6B example, but the spiral fluid flow is much less than that depicted in the FIG. 6A example. Thus, the energy dissipation and resistance to flow is much less in the FIG. 6B example, as compared to the FIG. 6A example.

Referring additionally now to FIG. 7, another nonlimiting configuration of the autonomous valve 80 is representatively illustrated. This configuration includes several more entrances 146 to the chamber 142 as compared to the configurations shown in FIGS. 6A-B. As illustrated in FIG. 7, there are at least two radially spaced apart sets of the spiral flow-inducing structures 144. Accordingly, it will be appreciated that a wide variety of different configurations of variable flow resistance systems may be constructed, without departing from the principles of the autonomous valve 80.

The entrances 146 gradually narrow in the direction of flow of the fluid composition 136. Narrowing the flow area may tend to increase the velocity of the fluid composition 136 somewhat, according to the Venturi principle, for example. As with configuration of FIGS. 6A-B, the resistance to flow through the autonomous valve 80 shown in FIG. 7 will tend to increase as the viscosity of the fluid composition 136 decreases and/or as its velocity increases. Conversely, the resistance to flow through the autonomous valve 80 of FIG. 7 will tend to decrease as the viscosity of the fluid composition 136 increases and/or as its velocity decreases.

In each of the autonomous valve 80 configurations described above, the structures 144 and/or 148 may be formed as vanes or as recesses defined on one or more walls of the chamber 142. If formed as vanes, the structures 144 and/or 148 may extend outwardly from the chamber 142 wall(s). If formed as recesses, the structures 144 and/or 148 may extend inwardly from the chamber 142 wall(s). The functions of inducing a desired direction of flow of the fluid composition 136, or of resisting a change in direction of the fluid composition flow, may be performed with any type, number, spacing, or configuration of structures 144, 148.

One skilled in the art with the benefit of this disclosure will readily appreciate the plurality of configurations for an autonomous valve suitable for use in conjunction with the present disclosure. Additional nonlimiting examples of autonomous valves suitable for use in conjunction with the present disclosure include those disclosed in U.S. Pat. App. Pub. Nos. 2011/0186300 entitled "Method and Apparatus for Autonomous Downhole Fluid Selection with Pathway Dependent Resistance System" filed on Feb. 4, 2010; 2011/0042091 entitled "Flow Path Control Based on Fluid Characteristics to Thereby Variably Resist Flow in a Subterranean Well" filed on Jun. 2, 2010, 2011/0297384 entitled "Variable cut flow Resistance System for Use in a Subterranean Well" filed on Jun. 2, 2010; and 2011/0297385 entitled "Variable Flow Resist System with Circulation Inducing Structure Therein to Variably Resist Flow in a Subterranean Well" filed on Jun. 2, 2010, the contents of each are hereby incorporated by reference to the extent not inconsistent with the present disclosure.

In some embodiments, an autonomous valve for use in conjunction with the present disclosure may include an inlet and an outlet sized to mitigate particle plugging. In some embodiments, the cross-section of an inlet or an outlet of an autonomous valve may independently have at least one dimension ranging from about 1 mm to about 10 mm, including any subset therebetween, e.g., about 1 mm to about 5 mm or about 2 mm to about 7 mm. It will be appreciated, however, that the cross-section dimension may vary, and even exceed 7 mm, without departing from the scope of the disclosure. Suitable cross-sectional shapes for an inlet or outlet of the autonomous valve may independently be circular, ovular, polygonal, or any hybrid thereof, e.g., square with rounded corners.

In some embodiments, an autonomous valve for use in conjunction with the present disclosure may be designed to separate fluids based on fluid viscosity. The flow path of the autonomous valve may be designed by changing the size and shape of the structures therein to retard the flow of a portion of the fluid having a viscosity of about 0.5 cP or less, about 2 cP or less, about 5 cP or less, about 10 cP or less, about 25 cP or less, or about 100 cP or less, and so on.

In some embodiments, an autonomous valve for use in conjunction with the present disclosure may be designed to balance flow among zones in the wellbore and/or subterranean formation so as to prevent fluid coning. For example, the flow path of the autonomous valve may be designed by changing the size and shape of the structures therein in order to retard the flow of a portion of the fluid once a predetermined or designated velocity is reached. Examples of materials from which the autonomous valve, or component thereof, may be made include, but are not limited to, polymers, steel, iron, brass, copper, bronze, tungsten, titanium, cobalt, nickel, combinations thereof, or the like.

Figure 8A:
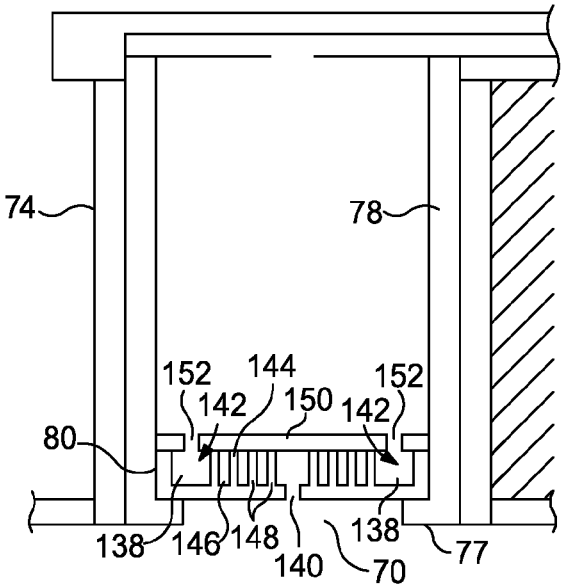
FIGS. 8A-C provide illustrations of a nonlimiting example of a configuration between a piston and an autonomous valve with a cross-section in the running position, a cross-section of in the operating position, and a top view of the autonomous valve having top, respectively.
Figure 8B:
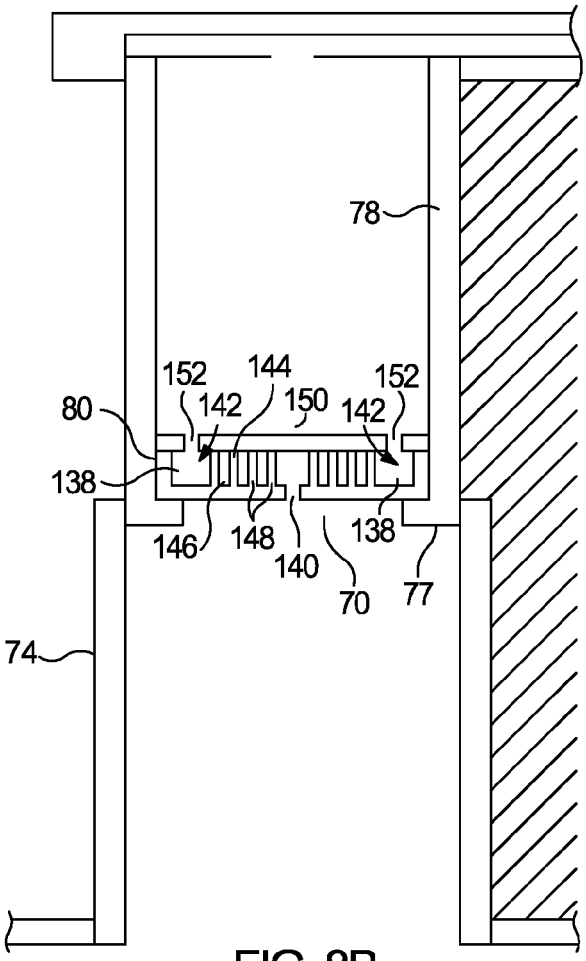

Referring now to FIGS. 8A-B, with continued reference to FIGS. 4A-B and 5A-B, illustrated are cross-sectional views of an exemplary configuration of a piston 74 and an autonomous valve 80, according to one or more embodiments. Specifically, FIG. 8A illustrates a cross-section in the running position and FIG. 8B illustrates as a cross-section in the operating position (i.e., with the piston 74 in its telescoped position). As shown in FIGS. 8A-B, the autonomous valve 80 is disposed or otherwise arranged within the telescoping portion 78 of the piston 74, which includes a lip 77 configured to seat or otherwise receive the autonomous valve 80. In one embodiment, the autonomous valve 80 is press fit into the telescoping portion 78. In other embodiments, however, the autonomous valve 80 may be threaded, welded, brazed, mechanically or adhesively fastened, combinations thereof, or the like to the telescoping portion 78. In some embodiments, an O-ring or the like may be used to prevent fluid flow around the autonomous valve. The autonomous valve 80 may include a top 150 that engages the structures 144, 148 and the walls of the flow chamber 142 so as to form the flow path and various entrances 146. Fluid enters the inlet(s) 138 through one or more apertures 152 defined in the top 150.

Figure 8C:
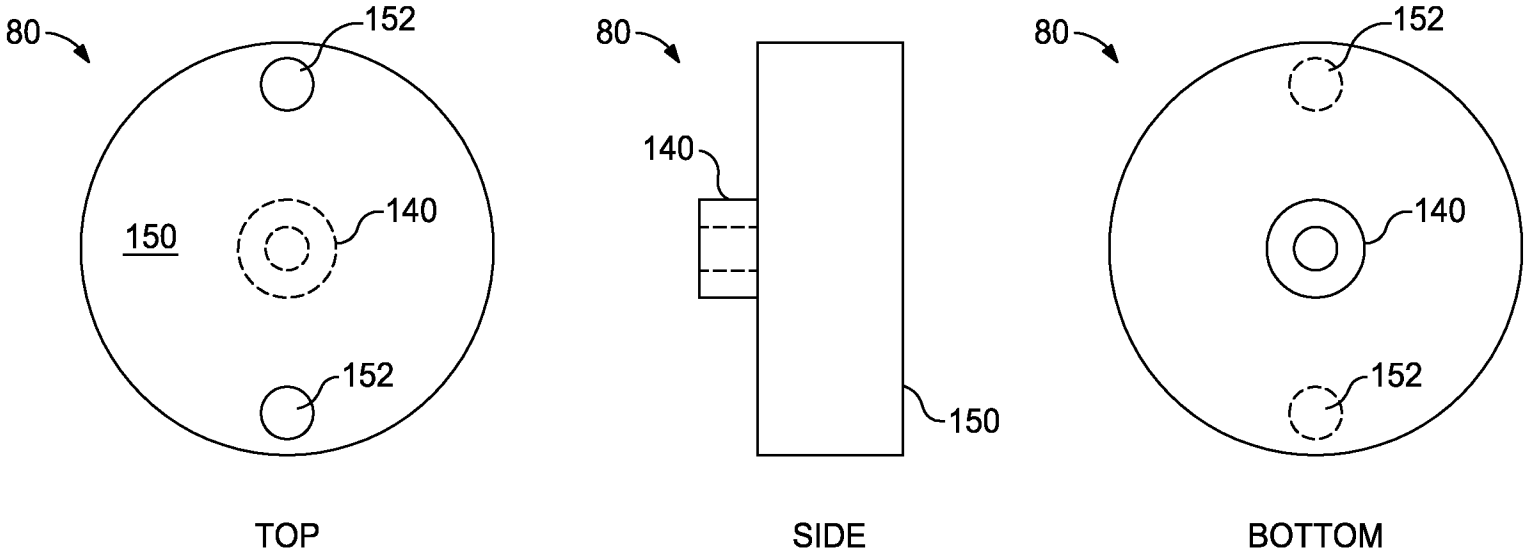

Referring now to FIG. 8C, illustrated are exemplary top, side, and bottom views of the autonomous valve 80 that may be arranged in the piston 74, according to one or more embodiments. The top view of the autonomous valve 80 depicts the top 150 as defining two apertures 152 that feed fluid flow into inlets 138 (FIGS. 8A-B) and therefore into the interior of the autonomous valve 80. The at least one outlet 140 is also shown in FIG. 8C and provides an outlet to the fluid after the fluid has circulated through the autonomous valve 80. This and similar configurations may advantageously provide for lower tolerances in the seating of the top 150 of the autonomous valve 80 so that fluid may pass freely through the passageways 152 (FIGS. 8A-B) and into the inlets 138.

Figure 9A:
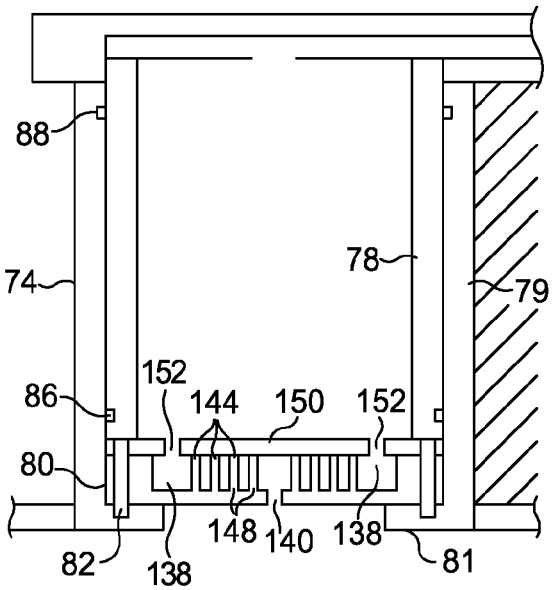
FIGS. 9A-B provide illustrations of a cross-section in the running position and as a cross-section of in the operating position, respectively, of a nonlimiting example of a configuration between a piston and an autonomous valve
Figure 9B:
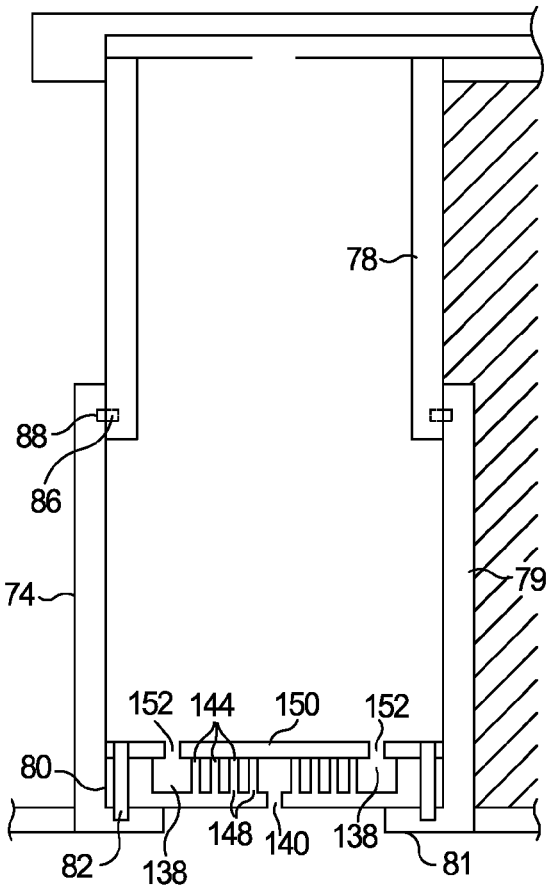

Referring now to FIGS. 9A-B, with continued reference to FIGS. 4A-B and 5A-B, illustrated is another exemplary configuration of a piston 74 and an autonomous valve 80, according to one or more embodiments. Specifically, FIG. 9A depicts a cross-section in the running position and FIG. 9B depicts a cross-section in the operating position (i.e., when the piston 70 is extended). As illustrated, the autonomous valve 80 may be disposed or otherwise arranged within the non-telescoping portion 79 of the piston 74, where the non-telescoping portion 79 includes a lip 81 configured to receive set screws 82 to provide secure placement for the autonomous valve 80. In other embodiments, however, the autonomous valve 80 may be threaded, welded, brazed, mechanically or adhesively fastened, or the like to the non-telescoping portion 79, without departing from the scope of the disclosure. The autonomous valve 80 includes a top 150 that is in intimate contact with structures 144, 148 and the walls of the flow chamber so as to form the flow path and entrances 146. Fluid enters inlet 138 through passageway 152 of top 150.

Further, the piston 74 may include a pin 86 in the telescoping portion 78 and a pin receiving slot 88 in the non-telescoping portion 79 to prevent extension of the telescoping portion 78 beyond the non-telescoping portion 79 of the piston 74 in the operating position. As mentioned above, one skilled in the art will recognize the plurality of mechanisms capable of preventing over extension.

While only one autonomous valve 80 is shown arranged in the piston 74 in each of FIGS. 8A-B and 9A-B, embodiments are contemplated herein that include multiple autonomous valves 80 arranged within the piston 74, without departing from the scope of the disclosure. For example, multiple autonomous valves 80 may be arranged in series, such as in a stacked configuration, within the telescoping portion 78 of the piston 74. In operation, the fluid exiting from a first autonomous valve 80 may enter the inlet 138 of a succeeding autonomous valve 80.

One skilled in the art with the benefit of this disclosure should understand the plurality of configurations for incorporating an autonomous valve suitable for use in conjunction with the present disclosure into a fluid flow path of a screen assembly described herein for a production well that passes from a subterranean formation through a filter material, a rigid member opening, the autonomous valve in a piston, and an opening in a base pipe so as to reach the flow path of the base pipe and be produced at the surface, or a flow path of the screen assembly in reverse order for an injection well.

One skilled in the art with the benefit of this disclosures will understand the plurality of configurations of screen assemblies. By way of nonlimiting example, a screen assembly may include a filter medium coupled to two pistons of two separate rigid members. As such, a base pipe can include a sidewall portion and having a first portion having a first opening and a second portion having a second opening therein. A first rigid member can be disposed exterior to the first portion of the base pipe, the first rigid member comprising a first piston; while a second rigid member can be disposed exterior to the second portion of the base pipe, the second rigid member comprising a second piston. The first piston can include a first telescoping portion and a first autonomous valve, wherein the first piston provides fluid communication passing through the first autonomous valve between a filter medium and the first opening in the first base pipe. Similarly, the second piston can include a second telescoping portion and a second autonomous valve, wherein the second piston provides fluid communication passing through the second autonomous valve between the filter medium and the second opening in the second base pipe. A swellable material can be disposed exterior to a third portion of the base pipe, the third portion of the base pipe located between the first portion of the base pipe and the second portion of the base pipe. The filter medium can be at least partially disposed exterior to the swellable material, where the filter medium is coupled to the first telescoping portion of the first piston near a first end of the filter medium and the second telescoping portion of the second piston near a second end of the filter medium. Further, the filter medium can be capable of filtering fluids and directing the fluids to the first piston and the second piston. Generally, in response to contact with an activating fluid, the swellable material can expand, displace the filter medium toward a surface of the bore, and extend the first telescoping portion of the first piston and the second telescoping portion of the second piston.

In some embodiments where more than one autonomous valve is used, the two or more autonomous valves may be the same or different. For example, a first autonomous valve may be use to retard the flow of a first portion of a fluid having a viscosity of about 25 cP or less, while a second autonomous valve may be used to retard the flow of a second portion of the fluid having a viscosity of about 5 cP or less.

Figure 10A:
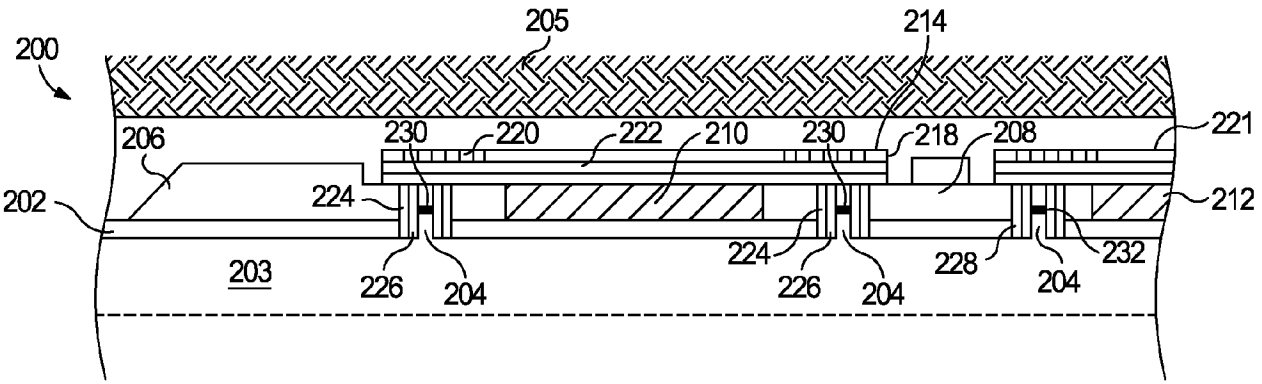
FIGS. 10A-B show a cross-sectional view of part of a screen assembly with multiple rigid members in a running configuration and an operating configuration, respectively.
Figure 10B:
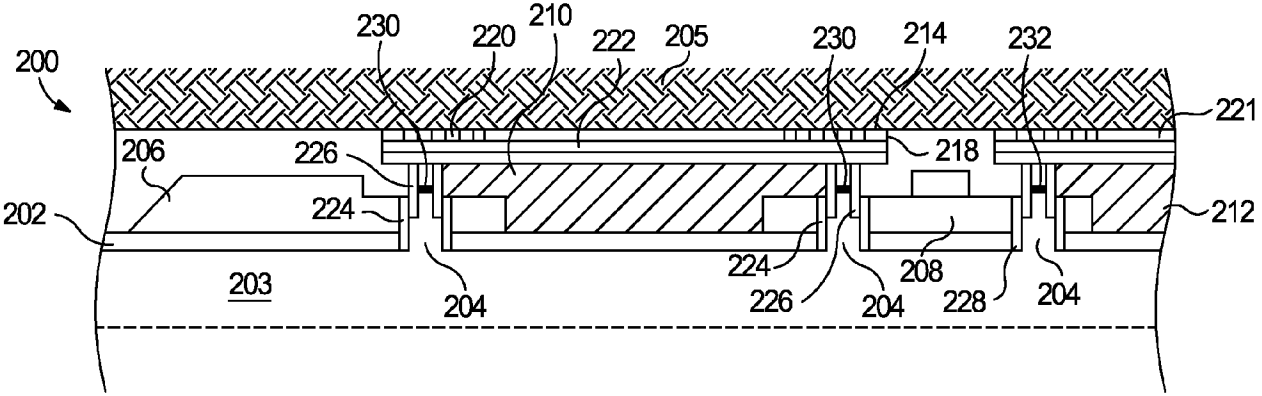

By way of yet another nonlimiting example, screen assemblies according to certain embodiments of the present disclosure can be constructed using multiple rigid members supporting multiple filter mediums extending longitudinally along an exterior of a base pipe. Referring to FIGS. 10A-B, with continued reference to FIGS. 5A-B, illustrated is a cross-sectional view of part of a screen assembly 200 with multiple rigid members in a running configuration and an operating configuration, respectively.

The screen assembly 200 includes a base pipe 202 that has openings 204 in a sidewall portion of the base pipe 202. The base pipe 202 can define an internal flow path 203 for hydrocarbon fluids produced by a formation 205. A first rigid member 206 is disposed exterior to a first circumferential portion of the base pipe 202. A second rigid member 208 is disposed exterior to a second circumferential portion of the base pipe 202. Swellable material 210 is disposed exterior to a third circumferential portion of the base pipe 202 between the first circumferential portion and the second circumferential portion. The second swellable material 212 may also be disposed exterior to a fourth circumferential portion of the base pipe 202 and longitudinally adjacent to the second rigid member 208.

A filter medium 214 is disposed exterior to the swellable material 210 and of part of the first and second rigid members 206, 208. The filter medium 214 can be in fluid communication with the internal flow path 203 through at least two base pipe openings 204 and pistons 224 of each of the first rigid member 206 and the second rigid member 208. The filter medium 214 includes a housing 218 with selected perforations 220 that allow fluid to flow to a filter media 222 disposed within the housing 218. The filter media 222 can filter particulate materials from the fluid and direct the filtered fluid to one or both pistons 224 in the first and second rigid members 206, 208.

A second filter medium 221 may be disposed exterior to the second swellable material 212 and part of the second rigid member 208. The second filter medium 220 may be constructed similar to the filter medium 214 and be configured to direct filtered hydrocarbon fluid to a second piston 228 arranged in second rigid member 208 or to an opening in another rigid member (not shown).

Each of the pistons 224 can be coupled to the filter medium 214 and each of the pistons 224 can include a telescoping portion 226. The second piston 228 can be constructed similar to pistons 224. Moreover, each of the pistons 224, 228 can have disposed therein autonomous valves 230, 232, respectively, similar to the embodiments of the autonomous valve 80 described above. Each of the autonomous valves 230, 232 may be the same or different.

Upon contact with an activating fluid, the swellable material 210 and second swellable material 212 may each be configured to expand radially to displace the filter medium 214 and second filter medium 220 to contact with the formation 205. Examples of the activating fluid include, but are not limited to, hydrocarbon fluid, water, and gas. The telescoping portion 226 of pistons 224 can extend radially to provide support to the filter medium 214 during the operating configuration and provide a conduit through which hydrocarbon fluid can flow from the filter media 222 through pistons 224 and eventually to the internal flow path 203. The second piston 228 may operate similarly for the second filter medium 220 during the operating configuration.

FIGS. 10A-B illustrate rigid members located proximate to ends of filter mediums. In other embodiments, rigid members are located proximate to other portions of filter mediums. For example, a rigid member can support a filter medium proximate to a middle of the filter medium during a running configuration and include openings through which hydrocarbon fluid can flow from the filter medium to an internal flow path of a base pipe. The rigid member 50 may be made from a metal, composite polymer, non-swelling rubber, or the like. Examples of metals from which the rigid member 206, 208 (i.e., rigid member 50 from FIGS. 5A-B) may be made include steel, iron, brass, copper, bronze, tungsten, titanium, cobalt, nickel, and a combination of these or other types of materials.

Screen assemblies according to some embodiments of the present disclosure can include multiple rigid members. For example, the rigid member 50 (FIGS. 5A-B) can be located exterior to a first portion of the base pipe and a second rigid member can be located exterior to a second portion of the base pipe. Filter mediums can be located between the two rigid members. In some embodiments, the rigid member 50 can support four filter mediums and the second rigid member can support four different filter mediums. FIG. 2 shows an example of a similar arrangement. The second rigid member can be rotated, for example by forty-five degrees relative to the rigid member 50, to align a receiving portion of the rigid member 50 with a non-receiving portion of the second rigid member that has a greater cross-sectional radius. In this configuration, the filter mediums associated with the rigid member 50 and filter mediums associated with the second rigid member can be positioned adjacent to each other in an alternating arrangement.

The swellable material discussed herein, according to certain embodiments, can be formed from one or more materials that swell upon contact with an activating fluid. For example, the swellable material may be a polymer that is capable of swelling to a size that is multiple times its initial size upon contact with an activating fluid that stimulates the material to expand. In some embodiments, the swellable material swells upon contact with an activating fluid that is a hydrocarbon fluid or a gas. The hydrocarbon fluid is absorbed by the swellable material and the absorption causes the volume of the swellable material to increase, thereby expanding radially. The swellable material may expand the filter mediums and part of the outer surface of the swellable material contacts a formation face in an open hole completion or a casing wall in a cased wellbore.

Some embodiments of the swellable material may be made from an elastic polymer. Examples of elastic polymers include ethylene propylene diene monomer (EPDM) rubber, styrene butadiene, natural rubber, ethylene propylene monomer rubber, ethylene vinyl acetate rubber, hydrogenized acrylonitrile butadiene rubber, acylonitrile butadiene rubber, isoprene rubber, chloroprene rubber and polynorbornene. The swellable material may also include other materials dissolved in, or in mechanical mixture, with the other materials that form the swellable material. Examples of other materials include fibers of cellulose, polyvinyl chloride, methyl methacrylate, acrylonitrile, ethylacetate, or other polymers.

In some embodiments, the swellable material is configured to expand upon contact with an activating fluid that is water. For example, the swellable material may be a water-swellable polymer such as a water-swellable elastomer or water-swellable rubber. More specifically, the swellable material may be a water-swellable hydrophobic polymer or water-swellable hydrophobic copolymer such as a water-swellable hydrophobic porous copolymer. Other polymers that can be used to form the swellable material include hydrophilic monomers and hydrophobically modified hydrophilic monomers. Examples of suitable hydrophilic monomers include acrylamide, 2-acrylamido-2-methyl propane sulfonic acid, N,N-dimethylacrylamide, vinyl pyrrolidone, dimethylaminoethyl methacrylate, acrylic acid, trimethylammonium-ethyl, methacrylate chloride, dimethylaminopropyl-methacrylamide, methacrylamide, and hydroxyethyl acylate.

A variety of hydrophobically modified hydrophilic monomers can be utilized in accordance with certain embodiments.

Examples of hydrophobically modified hydrophilic monomers include alkyl acrylates, alkyl methacrylates, alkyl acrylamides, alkyl methacrylamides (where alkyl radicals have from about 4 to about 22 carbon atoms), alkyl dimethylammoniumethyl methacrylate chloride and alkyl dimethylammoniumethyl methacrylate iodide (where the alkyl radicals have from about 4 to about 22 carbon atoms), alkyl dimethylammonium-propylmethacrylamide bromide, alkyl dimethylammonium propylmethacrylamide chloride and alkyl dimethylammonium-propylmethacrylamide iodide (where the alkyl groups have from about 4 to about 22 carbon atoms).

Polymers suitable in swellable material according to certain embodiments can be prepared by polymerizing any one or more of the hydrophilic monomers with any one or more of the hydrophobically modified hydrophilic monomers. The polymerization reaction can be formed in various ways, an example of which is described in U.S. Pat. No. 6,476,169, which is incorporated herein by reference. These polymers may have estimated molecular weights in the range from about 100,000 to about 10,000,000, with a preferred range of 250,000 to about 3,000,000. These polymers may also have mole ratios of the hydrophilic monomer(s) to the hydrophobically modified hydrophilic monomer(s) in the range of from about 99.98:0.02 to about 90:10.

In some embodiments, the swellable material may be made from a salt polymer such as polyacrylamide or modified crosslinked poly(meth)acrylate that tends to attract water from salt water through osmosis. For example, when water that flows from an area of low salt concentration (the formation water) to an area of high salt concentration (a salt polymer), across a semi-permeable membrane (an interface between the salt polymer and production fluids), the salt polymer allows water molecules to pass, but prevents passage of dissolved salts. In some embodiments, resins and/or tackifiers may be used to enhance conductivity within fracked portions of the reservoirs and further restrict the migration of fines, sand, or other proppant materials through the screens.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present disclosure. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

What is claimed is:

1. A screen assembly capable of being disposed in a wellbore, comprising:

a base pipe comprising a sidewall portion defining at least one opening therein;

a rigid member disposed about a first portion of the base pipe and having a piston arranged therein, the piston having a telescoping portion movably arranged within a non-telescoping portion;

an autonomous valve vertically arranged within the piston and providing fluid communication between a filter medium and the at least one opening in the base pipe, the filter medium being disposed at least partially about the base pipe and coupled to the telescoping portion of the piston, wherein the autonomous valve comprises:

a top defining at least two apertures that provide fluid communication from the filter medium into corresponding inlets of the autonomous valve;

a flow chamber in fluid communication with the corresponding inlets and through which a fluid composition is able to flow;

a bottom defining at least one outlet in fluid communication with the flow chamber; and at least one structure spirally oriented relative to the at least one outlet and configured to induce spiral flow of the fluid composition about the at least one outlet; and a swellable material disposed about a second portion of the base pipe, the filter medium being at least partially disposed about the swellable material and configured to filter and direct the fluids to the piston, wherein, as the swellable material expands, at least part of the filter medium is displaced toward an inner surface of the wellbore, thereby extending the telescoping portion.

2. The screen assembly of claim 1, wherein the top engages the at least one structure so as to form the flow chamber and wherein the at least one structure impedes a change in direction of flow of the fluid composition radially toward the at least one outlet.

3. The screen assembly of claim 2, wherein the at least one structure increasingly impedes the change in direction radially toward the at least one outlet in response to at least one of a) increased velocity of the fluid composition, b) decreased viscosity of the fluid composition, and c) a reduced ratio of desired fluid to undesired fluid in the fluid composition.

4. The screen assembly of claim 1, wherein the at least one structure comprises at least one of a vane and a recess.

5. The screen assembly of claim 1, wherein the at least one structure comprises multiple spaced apart structures.

6. The screen assembly of claim 5, wherein spacing between adjacent multiple spaced apart structures decreases in a direction of spiral flow of the fluid composition.

7. The screen assembly of claim 1, wherein the fluid composition flows more directly from the corresponding inlets to the at least one outlet as a viscosity of the fluid composition increases.

8. The screen assembly of claim 1, wherein the fluid composition flows more directly from the corresponding inlets to the at least one outlet as a velocity of the fluid composition decreases.

9. The screen assembly of claim 1, wherein the fluid composition flows more directly from the corresponding inlets to the at least one outlet as a ratio of desired fluid to undesired fluid in the fluid composition increases.

10. The screen assembly of claim 1, wherein the autonomous valve is coupled to the non-telescoping portion of the piston.

11. The screen assembly of claim 1, wherein the autonomous valve is coupled to the telescoping portion of the piston, and therefore moves with the telescoping portion.

12. The screen assembly of claim 11, wherein the telescoping portion includes a lip configured to seat the autonomous valve.

13. A method of producing a fluid composition from a subterranean formation, comprising:

introducing a screen assembly into the subterranean formation, the screen assembly comprising a base pipe defining at least one opening therein, a rigid member disposed about a first portion of the base pipe, a swellable material disposed about a second portion of the base pipe, and a filter medium at least partially disposed about the swellable material and coupled thereto;

expanding the swellable material toward an inner surface of a wellbore and thereby actuating a piston arranged within the rigid member, the piston having a telescoping portion coupled to the filter material and movably arranged within a non-telescoping portion of the piston;

filtering the fluid composition through the filter material and directing a filtered fluid to the piston;

receiving the filtered fluid with an autonomous valve vertically arranged within the piston, the autonomous valve comprising:

a top defining at least two apertures that provide fluid communication from the filter medium into corresponding inlets of the autonomous valve;

a flow chamber in fluid communication with the corresponding inlets and through which a fluid composition is able to flow;

a bottom defining at least one outlet in fluid communication with the flow chamber; and at least one structure spirally oriented relative to the at least one outlet; and inducing spiral flow of the fluid composition about the at least one outlet using the at least one structure and thereby regulating a flow of the filtered fluid through the piston.

14. The method of claim 13, further comprising impeding a change in direction of flow of the filtered fluid radially toward the at least one outlet using the at least one structure.

15. The method of claim 13, further comprising flowing the filtered fluid more directly from the corresponding inlets to the at least one outlet as a viscosity of the filtered fluid increases.

16. The method of claim 13, further comprising flowing the filtered fluid more directly from the corresponding inlets to the at least one outlet as a velocity of the filtered fluid decreases.

17. The method of claim 13, further comprising flowing the filtered fluid more directly from the corresponding inlets to the at least one outlet as a ratio of desired fluid to undesired fluid in the filtered fluid increases.

18. A screen assembly capable of being disposed in a wellbore, comprising:

a base pipe comprising a sidewall portion having a first portion that defines a first opening and a second portion that defines a second opening;

a first rigid member disposed about the first portion of the base pipe and having a first piston arranged therein, the first piston having a first telescoping portion movably arranged within a first non-telescoping portion;

a second rigid member disposed about the second portion of the base pipe and having a second piston arranged therein, the second piston having a second telescoping portion arranged within a second non-telescoping portion;

a first autonomous valve vertically arranged within the first piston and providing fluid communication between a filter medium and the first opening in the first base pipe, the filter medium being disposed at least partially about the base pipe and coupled to the first telescoping portion of the first piston near a first end of the filter medium;

a second autonomous valve vertically arranged within the second piston and providing fluid communication between the filter medium and the second opening in the second base pipe, the filter medium also being coupled to the second telescoping portion of the second piston near a second end of the filter medium, wherein each of the first and second autonomous valves comprise:

a top defining at least two apertures that provide fluid communication from the filter medium into corresponding inlets of the corresponding autonomous valve;

a flow chamber in fluid communication with the corresponding inlets and through which a fluid composition is able to flow;

a bottom defining at least one outlet in fluid communication with the flow chamber; and at least one structure spirally oriented relative to the at least one outlet and configured to induce spiral flow of the fluid composition about the at least one outlet; and a swellable material disposed about a third portion of the base pipe located between the first portion and the second portion, the filter medium being at least partially disposed about the swellable material and capable of filtering fluids and directing the fluids to the first piston and the second piston, wherein, as the swellable material expands, at least a portion of the filter medium is displaced toward a surface of the wellbore, thereby extending the first and second telescoping portions.

19. The screen assembly of claim 18, wherein the top of each of the first and second autonomous valves engages the at least one structure so as to form the flow chamber and wherein the at least one structure impedes a change in direction of flow of the fluid composition radially toward the at least one outlet.

20. The screen assembly of claim 19, wherein the at least one structure increasingly impedes the change in direction radially toward the at least one outlet in response to at least one of a) increased velocity of the fluid composition, b) decreased viscosity of the fluid composition, and c) a reduced ratio of desired fluid to undesired fluid in the fluid composition.

21. The screen assembly of claim 18, wherein the at least one structure comprises at least one of a vane and a recess.

22. The screen assembly of claim 18, wherein the at least one structure comprises multiple spaced apart structures.

23. The screen assembly of claim 22, wherein spacing between adjacent multiple spaced apart structures decreases in a direction of spiral flow of the fluid composition.

24. The screen assembly of claim 18, wherein the fluid composition flows more directly from the corresponding inlets to the at least one outlet as a viscosity of the fluid composition increases.

25. The screen assembly of claim 18, wherein the fluid composition flows more directly from the corresponding inlets to the at least one outlet as a velocity of the fluid composition decreases.

26. The screen assembly of claim 18, wherein the fluid composition flows more directly from the corresponding inlets to the at least one outlet as a ratio of desired fluid to undesired fluid in the fluid composition increases.

27. The screen assembly of claim 18, wherein one or both of the first and second autonomous valves is coupled to the corresponding first and second non-telescoping portion of the first and second pistons, respectively.

28. The screen assembly of claim 18, wherein one or both of the first and second autonomous valves is coupled to the corresponding first and second telescoping portions of the first and second pistons, respectively, and therefore moves with the first or second telescoping portions.

29. The screen assembly of claim 28, wherein one or both of the first and second telescoping portions includes a lip configured to seat the corresponding autonomous valve.

* * * * *